US009410727B1

(12) United States Patent
Boyko

(10) Patent No.: US 9,410,727 B1
(45) Date of Patent: Aug. 9, 2016

(54) SYSTEMS AND METHODS FOR DEFROSTING AN EVAPORATOR IN A REFRIGERATION SYSTEM

(75) Inventor: James G. Boyko, Gorham, ME (US)

(73) Assignee: Hill Phoenix, Inc., Conyers, GA (US)

( * ) Notice: Subject to any disclaimer, the term of this patent is extended or adjusted under 35 U.S.C. 154(b) by 822 days.

(21) Appl. No.: 13/560,242

(22) Filed: Jul. 27, 2012

(51) Int. Cl.

| | |
|---|---|
| ***F25B 41/00*** | (2006.01) |
| ***F25B 47/00*** | (2006.01) |
| ***F25B 47/02*** | (2006.01) |
| *F25B 45/00* | (2006.01) |
| *F25B 21/04* | (2006.01) |
| *F25B 21/00* | (2006.01) |

(52) U.S. Cl.
CPC ..... *F25B 47/006* (2013.01); *F25B 47/02* (2013.01); *F25B 21/00* (2013.01); *F25B 21/04* (2013.01); *F25B 45/00* (2013.01); *F25B 2339/044* (2013.01); *F25B 2400/16* (2013.01)

(58) Field of Classification Search
CPC ..... F25B 47/02; F25B 2400/16; F25B 2339/044; F25B 45/00; F25B 47/006; F25D 21/04; F25D 21/00
USPC ..... 62/277, 509, 174, 80, 81
See application file for complete search history.

(56) References Cited

U.S. PATENT DOCUMENTS

| | | | | |
|---|---|---|---|---|
| 2,069,201 | A | 2/1937 | Allison | |
| 2,688,850 | A | 9/1954 | White | |
| 2,970,816 | A * | 2/1961 | McCarty | 165/231 |
| 3,098,363 | A | 7/1963 | Shrader | |
| 3,636,723 | A | 1/1972 | Kramer | |
| 4,318,277 | A | 3/1982 | Cann et al. | |
| 5,065,584 | A | 11/1991 | Byczynski et al. | |
| 5,070,705 | A * | 12/1991 | Goodson et al. | 62/197 |
| 5,157,933 | A * | 10/1992 | Brendel | 62/196.4 |
| 5,937,660 | A * | 8/1999 | Lau et al. | 62/174 |
| 7,331,189 | B2 * | 2/2008 | Yoshida et al. | 62/151 |
| 7,716,936 | B2 * | 5/2010 | Bailey et al. | 62/151 |
| 2006/0130504 | A1 * | 6/2006 | Agrawal | F25B 49/02 62/228.4 |
| 2006/0162358 | A1 * | 7/2006 | VanderZee | 62/225 |

OTHER PUBLICATIONS

Conventional Refrigeration Systems, Retail Food Store Refrigeration and Equipment; 2010 ASHRAE Handbook. Refrigeration I-P Edition; 2010, p. 15.19; American Society of Heating, Refrigerating and Air-Conditioning Engineers, Inc.; Atlanta, GA, USA.

Whitman et al.; Defrost Using Internal Heat (Hot Gas Defrost); Refrigeration and Air Conditioning Technology, 6th Edition; 2009; p. 530-531; Delmar; Clifton Park, NY, USA.

(Continued)

*Primary Examiner* — Marc Norman
*Assistant Examiner* — David Teitelbaum
(74) *Attorney, Agent, or Firm* — Foley & Lardner LLP

(57) ABSTRACT

A gas defrosting method is disclosed which provides a distinct two-step process for defrosting a frosted evaporator. In deliberate fashion, the method assures that only refrigerant vapor returns to the compressor and thereby protects the compressor from damage due to receiving liquid refrigerant. The method optimizes the heat transfer process by maintaining full refrigerant flow through the condenser and by controlling the vapor in a nearly saturated state, high density state. In addition, the method strives to minimize the compressor power expended during the defrosting process.

16 Claims, 1 Drawing Sheet

(56) References Cited

OTHER PUBLICATIONS

Whitman et al.; Automatic Pumpdown Systems; Refrigeration and Air Conditioning Technology, 6th Edition; 2009; p. 520-523; Delmar; Clifton Park, NY, USA.

Admiraal, D. and Bullard, C.; Appendix E; Calculation of Refrigerant Mass Flow Rate, "Heat Transfer in Refrigerator Condensers and Evaporators"; University of Illinois paper #ACRC TR-48; Aug. 1993; p. 52-55; Air Conditioning and Refrigeration Center, University of Illinois, Urbana, IL, USA.

* cited by examiner

| Mode | Operatable Part | | | | | | Reason for termination |
|---|---|---|---|---|---|---|---|
| | 10 | 12 | 14 | 18 | 22 | 27 | |
| Refrigeration | On | On | On | Open | Open | Closed | frost buildup |
| Defrost Step #1 | On | On | On | Open | Closed | Closed | liquid in receiver |
| Defrost Step #2 | On | Off | On | Closed | Open | Open | frost removed |

SYSTEMS AND METHODS FOR DEFROSTING AN EVAPORATOR IN A REFRIGERATION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention relates to the field of mechanical refrigeration which requires the periodic removal of frost from the evaporator heat transfer surfaces.

Methods which perform evaporator defrosting using refrigerant gas are well established by open-source technical publications. As stated by ASHRAE Handbook-Refrigeration-2010, Chapter 15: Retail Food Store and Equipment, compressor discharge gas or gas from the top of the warm receiver at saturated conditions flows to the evaporators requiring defrost. But during this process, the gas can condense to a liquid state and subsequently cause damage to the compressor. This persistent problem has been the attention of much patent activity but these efforts have lead to complex and ineffective solutions. Therefore the refrigeration industry still required a simple, reliable and cost-effective method of defrosting using refrigerant gas.

From a review of the technical literature and patent history, it appears two general concepts have been applied in an attempt to reduce compressor damage during gas defrost. One general concept has focused on methods for handling liquid refrigerant returning to the compressor, either by capture, diversion or re-evaporation. A clear example of this concept is presented by U.S. Pat. No. 4,318,277 to Cann et al which describes an accumulator for capturing liquid refrigerant returning to the compressor and then the utilization of hot gas from the compressor to vaporize the captured liquid refrigerant. And in similar fashion, U.S. Pat. No. 3,636,723 to Kramer explains the application of a heater for re-evaporating the captured liquid.

The second general concept has focused on methods for recirculating refrigerant vapor from the condenser to the evaporator while bypassing the expansion valve, thereby attempting to transfer heat from the ambient medium (typically the outside air) to the frost by using the compressor to recirculate refrigerant from the condenser to the evaporator. U.S. Pat. No. 2,069,201 to Allison describes the actuation of a bypass loop from the condenser to the evaporator but fails to assure that the loop contains only vapor prior to actuation. It is therefore believed that this method would result in substantial compressor damage. Likewise U.S. Pat. No. 5,065,584 to Byczynski explains an actuated recirculation loop from the condenser-to-evaporator-to-compressor but does not provide a means for sequestering liquid refrigerant that may reside within this loop prior to actuation. U.S. Pat. No. 2,688,850 to White and U.S. Pat. No. 3,098,363 to Shrader describe an alternate method of recirculating refrigerant vapor from the condenser to the evaporator which diverts a portion of the refrigerant flow from the condenser. This diversion, or condenser bypass, significantly reduces performance of the condenser and thus the condenser cannot achieve its full potential for heat transfer.

In summary, a review of technical literature and prior art shows that gas-defrost can be an effective means of removing frost from evaporators. Nevertheless, in its current form as shown by prior art, gas-defrost can still lead to compressor failure and there are opportunities for improving its effectiveness. Therefore, what is needed is a gas-defrost method which assures that liquid does not return to the compressor. What is further needed is a gas-defrost method which transfers the maximum amount of heat from the ambient medium to the frosted evaporator. In order to achieve commercial viability, what is yet further needed is an effective defrosting method which operates with minimal compressor power and can be easily and reliably implemented.

BRIEF SUMMARY OF THE INVENTION

An object of the present invention is to provide a refrigeration gas defrost method which will not damage the compressor due to liquid refrigerant returning to the compressor. A further object of present invention is to provide a refrigeration gas defrost method that fully transfers the heat available from the ambient medium to the frosted evaporator and thus the defrost process can be accomplished within a minimum amount of time. A further object of the present invention is to provide a gas defrost method which expends a minimum amount of compressor power and can be easily and reliably implemented, thus becoming commercially viable.

In order to achieve these objects, the present invention proposes a defrosting sequence of events which first sequesters the liquid refrigerant within a containment vessel and then recirculates refrigerant vapor between the compressor, condenser and the frosted evaporator. In this manner, heat from the ambient medium is transferred from the condenser to the frosted evaporator and thus used to melt the frost from the evaporator. The present invention assures that refrigerant returning to the compressor is always in a superheated state and therefore cannot damage the compressor with liquid refrigerant. The present invention strives to minimize the time required to defrost the evaporator by applying two features. First, the present invention assures that the refrigerant gas does not bypass the condenser and thus fully transfers the heat available from the ambient medium to the frosted evaporator. And second, the present invention maintains the refrigerant gas returning to the compressor at a pressure slightly below its saturation pressure and therefore maximizes the mass flowrate of refrigerant and subsequently maximizes the transfer heat from the ambient medium to the frosted evaporator. And further, the present invention strives to minimize the pressure differential across the compressor and thereby maintains low compressor power while defrosting the frosted evaporator. And further still, the present invention requires the application of only a minimal number of standard-practice components and therefore is anticipated to provide cost-effective, reliable service.

Due to the novelty of the stated method, the development of this invention required the construction and testing of prototype assemblies. The testing confirmed that the stated method provides a quick defrosting without damaging the compressor and therefore the present invention is considered commercially viable.

REFERENCE NUMERALS IN DRAWINGS

Reference numerals applied to all drawings

Figures 1, 2:
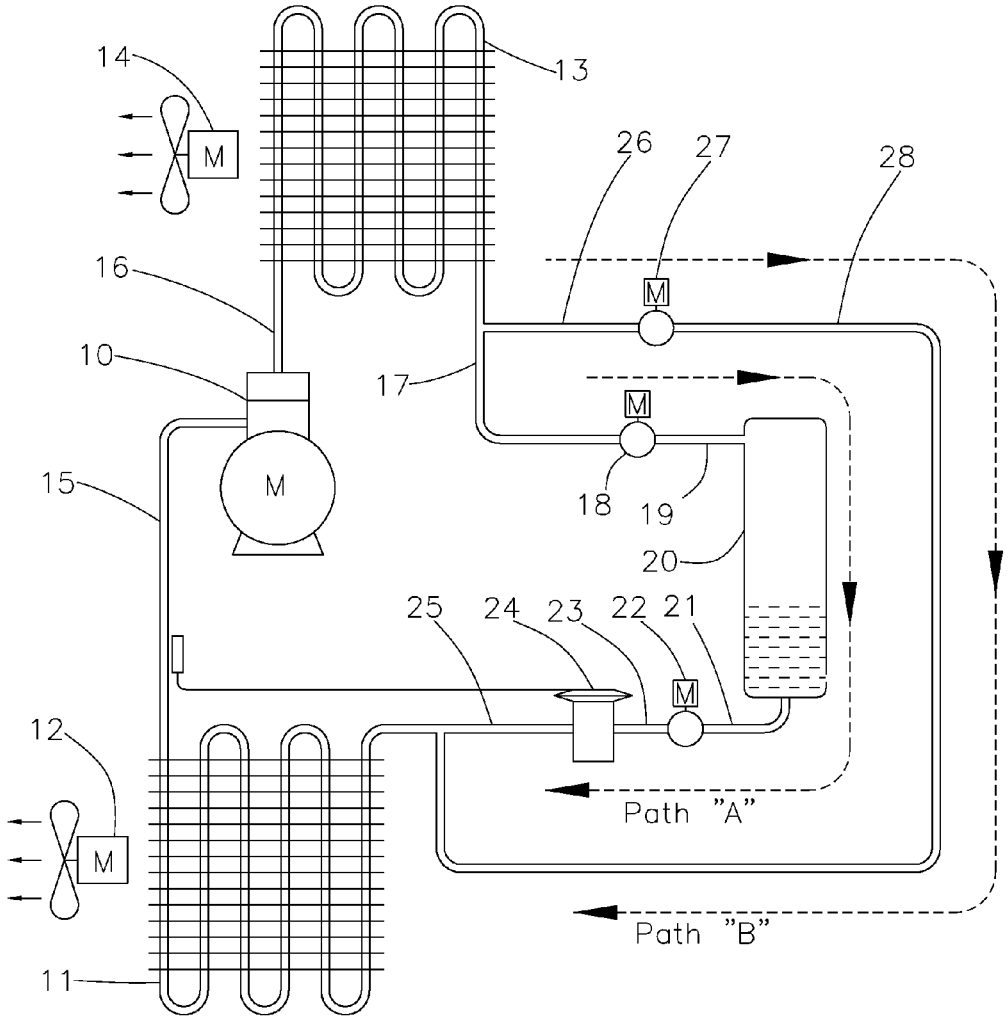
FIG. 1 is a schematic piping diagram of a conventional refrigeration system which has been embellished by the principle features of the invention.
FIG. 2 is a sequence-of-events table which identifies the sequential action required to implement the invention.

10 Compressor
11 Evaporator
12 Fan
13 Condenser
14 Fan
15 Pipe
16 Pipe
17 Pipe
18 Valve
19 Pipe
20 Receiver
21 Pipe
22 Valve
23 Pipe
24 Expansion valve
25 Pipe
26 Pipe
27 Valve
28 Pipe

DETAILED DESCRIPTION OF THE INVENTION

This invention relates to the field of refrigeration utilizing a condenser which is exposed to an ambient medium warmer than the freezing point of water, and further to the field of refrigeration utilizing an evaporator operating at temperatures below the freezing point of water and finally to the field of refrigeration utilizing an evaporator which is exposed to moist air.

In FIG. 1, compressor 10 transfers refrigerant vapor from evaporator 11 to condenser 13. Evaporator 11 is connected to compressor 10 with pipe 15. Evaporator 11 is a heat exchanger which absorbs heat from the surrounding air. The surrounding air traverses evaporator 11 using fan 12. Compressor 10 is connected to condenser 13 with pipe 16. Condenser 13 is a heat exchanger which transfers heat either to or from the ambient medium. As shown by this embodiment, the ambient medium is air which traverses condenser 13 using fan 14. But other forms of ambient medium can likewise be applied without departing from the scope of the invention. For example, the ambient medium could be water instead of air which could traverse condenser 13 using a pump instead of a fan.

Refrigerant is now transferred to evaporator 11 along two alternate paths, marked on FIG. 1 as "A" and "B". Along path "A", condenser 13 is connected to valve 18 with pipe 17. Valve 18 is connected to receiver 20 with pipe 19. Valve 18 is of the two-position type (either open or closed) and can be actuated by any means (for example, manually or electrically actuated). As an alternate form, valve 18 could be a check-valve type, allowing flow to travel from pipe 17 to pipe 19 but prevent flow to travel from pipe 19 to pipe 17. Receiver 20 is a storage vessel of sufficient size to store all of the liquid refrigerant within the refrigeration system. Receiver 20 is connected to valve 22 with pipe 21. Valve 22 is of the two-position type (either open or closed) and can be actuated by any means (for example, manually or electrically actuated). Valve 22 is connected to expansion valve 24 with pipe 23. Expansion valve 24 is connected to evaporator 11 with pipe 25. In summary, a continuous path "A" is formed from condenser 13 to evaporator 11 by the sequential connection of parts 17-18-19-20-21-22-23-24-25. Along path "B", condenser 13 is connected to valve 27 with pipe 26. Valve 27 is of the two-position type (either open or closed) and can be actuated by any means (for example, manually or electrically actuated). Valve 27 is connected to evaporator 11 with pipe 28. In summary, an alternate continuous path "B" is formed from condenser 13 to evaporator 11 by the sequential connection of parts 26-27-28.

The operation of the preferred embodiment is now described. During the process of refrigeration, compressor 10 pressurizes refrigerant vapor to a hot, high-pressure state. The hot, high-pressure vapor flows through pipe 16 to condenser 13. The ambient medium transverses condenser 13 using energized fan 14, causing heat to flow from the hot, high-pressure vapor to the ambient medium and subsequently causing the hot, high-pressure vapor to condense into a high-pressure liquid. Valve 18 and valve 22 are open and therefore the high pressure liquid is allowed to flow to evaporator 11 along path "A". Valve 27 is closed and therefore flow is prevented along Path "B". While flowing along path "A", expansion valve 24 imparts a significant loss in pressure to the high-pressure liquid, causing the high-pressure liquid to expand to cold low-pressure mixture of liquid and vapor before entering evaporator 11.

The surrounding air traverses evaporator 11 using energized fan 12, causing heat to flow from the surrounding air to the cold low-pressure mixture of liquid and vapor, causing the mixture to transition to cold low-pressure vapor. The cold low-pressure vapor travels to compressor 10 through pipe 15. The cold low-pressure vapor is then re-compressed to hot, high-pressure vapor to complete the refrigeration cycle.

It is now noted that compressor 10 is specifically design to receive only vapor and compressor 10 can be damaged if instead liquid is received. Therefore, the specific purpose of expansion valve 24 is to modulate the refrigerant flow to evaporator 11 to assure that the refrigerant traveling to compressor 10 is slightly superheated vapor, with the amount of superheat generally in the range of 5 F to 10 F. (Superheat is defined as the difference between the actual temperature of the vapor and the temperature at which the vapor will start to condense). To this end, expansion valve 24 reduces the refrigerant flow to evaporator 11 if a low superheat is sensed, and conversely, expansion valve 24 increases the refrigerant flow to evaporator 11 if a high superheat is sensed.

As heat is removed from evaporator 11, frost can form on the outside surface of evaporator 11 if the outside surface of evaporator 11 is below the freezing point of water and the surrounding air contains water vapor. This formation of frost will eventually impede the surrounding air from traversing evaporator 11 and thus become an impediment to the transfer of heat. At this point in time, the frost must be removed from evaporator 11 with a process typically called "defrosting".

An improved method for defrosting is the focus of the subject invention and is accomplished by implemented two distinct steps:

Step #1 is initiated by closing valve 22. With the closing of valve 22, high pressure liquid refrigerant is prevented from flowing to evaporator 11 and subsequently the residual liquid refrigerant within evaporator 11 is quickly transformed to a vapor and transferred by compressor 10 to condenser 13. Within condenser 13, the vapor condenses to a liquid state and the liquid travels through valve 18 to receiver 20. Step #1 is terminated when all of the liquid refrigerant within the refrigeration system has been stored in receiver 20. Thus at the termination of Step #1, evaporator 11 and condenser 13 contain only refrigerant vapor. It is now noted that the stated Step #1 procedure is in accordance with the common refrigeration practice termed "pump-down" as described by typical refrigeration references such as Refrigeration & Air Conditioning Technology 6$^{th}$ Edition; Whitman, et al. As described by the stated reference, the termination of Step #1 is readily determined by sensing a substantial pressure reduction with evaporator 11.

Step #1 is terminated and then Step #2 is initiated by closing valve 18, opening valve 27 and de-energizing fan 12. With valve 18 closed, liquid refrigerant stored in receiver 20 is not allowed to leave receiver 20. With valve 27 open, refrigerant vapor can freely recirculate from condenser 13 to evaporator 11 to compressor 10 along Path "B". Thus refrigerant vapor recirculating from condenser 13 to evaporator 11 to compressor 10 remains in a vapor state and compressor 10 is protected from damage due to receiving refrigerant in the liquid state. It is now also noted that the ambient medium traversing condenser 13 is warmer than evaporator 11 in its frosted state and therefore heat is transferred from the ambient medium to the refrigerant vapor as the refrigerant vapor flows through condenser 13 and then from the refrigerant vapor to evaporator 11 as the refrigerant vapor flows through evaporator 11. When fan 12 is de-energized, the stated heat is not transferred to the surrounding air but instead is fully applied to the frost on the outside surfaces of evaporator 11 and sequentially the frost starts to convert to a liquid and drips off of evaporator 11 thus initiating the defrost process. It is further noted that Path "B" bypasses the flow restriction imposed by expansion valve 24 and therefore can maintain the refrigerant vapor flow from condenser 13 to evaporator 11 with minimal effort. It is also further noted that the refrigerant vapor flow through Path "B" is only from condenser 13, without any refrigerant bypassing condenser 13 as described by the stated prior art, and therefore the heating effectiveness of condenser 13 is fully realized.

Step #2 can be solely used to fully defrost evaporator 11 but the period of time required to fully defrost evaporator 11 can be reduced by also opening valve 22. With the opening of valve 22, high pressure liquid refrigerant is allowed to flow to expansion valve 24 and subsequently expansion valve 24 introduces liquid refrigerant into the refrigerant vapor recirculating from condenser 13 to evaporator 11 to compressor 10. Since the stated recirculating refrigerant vapor is in a superheated state, the liquid refrigerant introduced by expansion valve 24 is vaporized. By virtue of its purposeful design, expansion valve 24 introduces liquid refrigerant into the stated recirculating refrigerant vapor only as required to maintain the vapor traveling to compressor 10 in a slightly superheated state and thus compressor 10 remains protected from damage due to receiving refrigerant in the liquid state. It is now noted that heat transfer effectiveness of the vapor recirculating from condenser 13 to evaporator 11 to compressor 10 is highly dependent on the density (mass per unit volume) of the stated recirculating vapor, as explained by "Heat Transfer in Refrigerator Condensers and Evaporators", Admiral, D. and Bullard, C., University of Illinois paper #ACRC TR-48; dated August 1993. And it is further noted that saturated refrigerant vapor is denser than superheated vapor and therefore the highest vapor density is achieved by maintaining the vapor as near to the saturated state as possible; that is, in a nearly saturated state. Therefore, with the opening of valve 22, vapor recirculating from condenser 13 to evaporator 11 to compressor 10 is maintained at the highest practical density, thereby achieving the highest rate of heat transfer and subsequently minimizing the period of time required to defrost evaporator 11. Step #2 is terminated when all of frost has been removed from evaporator 11. Well-established refrigeration practices are available for sensing the point of complete frost removal. Again referring to Whitman, et al., the point of complete frost removal is commonly indicated by sensing when the surface of evaporator 11 has risen above the freezing point of water. At the termination of Step #2, the refrigeration system returns to its standard cooling mode by closing valve 27 and energizing fan 12.

FIG. 2 delineates the sequence of events for the preferred embodiment in tabular form. Three distinct modes of operations are shown: normal refrigeration and the two steps of defrost per the subject invention. For normal refrigeration, compressor 10 is energized, fan 12 is energized, fan 14 is energized, valve 18 is open, valve 22 is open and valve 27 is closed. Normal refrigeration is terminated and Step #1 is initiated when excessive frost has accumulated on the outside surface of evaporator 11. For Step #1, compressor 10 is energized, fan 12 is energized, fan 14 is energized, valve 18 is open, valve 22 is closed and valve 27 is closed. Step #1 is terminated and Step #2 is initiated when it is perceived that all of the liquid refrigerant is stored within receiver 20. As per common "pump-down" refrigeration practice, this condition can be identified by a low refrigerant pressure within evaporator 11. For Step #2, compressor 10 is energized, fan 12 is de-energized, fan 14 is energized, valve 18 is closed, valve 22 is open and valve 27 is open. Step #2 is terminated and the system returns to normal refrigeration when all of the frost has been removed from evaporator 11, generally sensed when the temperature of evaporator 11 has risen above the freezing point of water.

In conclusion, the preferred embodiment of the present invention provides a method of a defrosting method which assures that only superheated vapor leaves the evaporator and thereby protects the compressor from damage due to the return of liquid refrigeration. In addition, the preferred embodiment of the present invention minimizes the amount of time required for defrosting by applying two features: 1) the full refrigerant flow is directed to the condenser, with no means of bypass, so that heat transfer capability of the condenser is fully realized and 2) the density of the superheated vapor leaving the evaporator is maintained at the highest practical density so that the heat transfer rates within the condenser and evaporator are maximized. Furthermore, the preferred embodiment of the present invention minimizes the pressure differential across the compressor and subsequently minimizes the compressor power required for defrosting. And further still, the preferred embodiment of the present invention requires only a few additional standard parts and therefore is deemed to be both practical and commercially viable.

It should be understood that the preferred embodiment is merely illustrative of the present invention. Numerous variations in design and use of the present invention may be contemplated in view of the following claims without straying from the intended scope and field of the invention disclosed herein.

I claim:

1. A refrigeration system operable in a refrigeration mode and a defrost mode, the refrigeration system comprising:

an evaporator that transfers heat to a refrigerant in the refrigeration mode and absorbs heat from the refrigerant in the defrost mode;

a condenser that transfers heat from the refrigerant to an ambient medium flowing through the condenser in the refrigeration mode and transfers heat from the ambient medium flowing through the condenser to the refrigerant in the defrost mode;

a compressor fluidly connected in series between the evaporator and the condenser, the compressor configured to circulate the refrigerant through the evaporator and the condenser, wherein the refrigerant absorbs heat in the evaporator and rejects heat in the condenser in the refrigeration mode, and absorbs heat in the condenser and rejects heat in the evaporator in the defrost mode, wherein the compressor delivers the refrigerant to the condenser at a refrigerant temperature below the temperature of the ambient medium flowing through the condenser in the defrost mode such that the refrigerant absorbs heat from the ambient medium flowing through the condenser and transfers the heat absorbed from the ambient medium to the evaporator;

a first parallel path fluidly connecting an outlet of the condenser with an inlet of the evaporator, the first parallel path comprising:

a receiver configured to store the refrigerant in a liquid state, the receiver having a receiver inlet valve and a receiver outlet valve;

an expansion valve fluidly connected in series between the receiver outlet valve and the inlet of the evaporator; and the refrigerant which flows from the condenser to the evaporator via the first parallel path when the refrigeration system operates in the refrigeration mode; and a second parallel path arranged in parallel with the first parallel path, the second parallel path comprising:

a bypass valve fluidly connected in series between the outlet of the condenser and the inlet of the evaporator; and the refrigerant which flows from the condenser to the evaporator via the second parallel path when the refrigeration system operates in the defrost mode, the refrigerant in the second parallel path comprising the heat absorbed from the ambient medium flowing through the condenser;

wherein the refrigeration system is configured to operate the receiver inlet valve, the receiver outlet valve, and the bypass valve to transition between the refrigeration mode and the defrost mode.

2. The refrigeration system of claim 1, wherein the first parallel path is configured to cause a temperature of the refrigerant to decrease to a temperature below an ambient evaporator temperature and to deliver the refrigerant to the evaporator at the temperature below the ambient evaporator temperature; and wherein the second parallel path is configured to deliver the refrigerant to the evaporator at a temperature above the ambient evaporator temperature.

3. The refrigeration system of claim 1, wherein in the refrigeration mode, the compressor is configured to cause a temperature of the refrigerant to increase to a temperature above an ambient condenser temperature and to deliver the refrigerant to the condenser at the temperature above the ambient condenser temperature; and wherein in the defrost mode, the compressor is configured to deliver the refrigerant to the condenser at a temperature below the ambient condenser temperature.

4. The refrigeration system of claim 1, wherein in the refrigeration mode:

the receiver inlet valve and the receiver outlet valve are open to allow the refrigerant to flow from the outlet of the condenser to the inlet of the evaporator via the first parallel path; and the bypass valve is closed to prevent the refrigerant from flowing from the outlet of the condenser to the inlet of the evaporator via the second parallel path.

5. The refrigeration system of claim 1, wherein in the defrost mode:

at least one of the receiver inlet valve and the receiver outlet valve are closed to prevent the refrigerant from flowing from the outlet of the condenser to the inlet of the evaporator via the first parallel path; and the bypass valve is open to allow the refrigerant to flow from the outlet of the condenser to the inlet of the evaporator via the second parallel path.

6. The refrigeration system of claim 1, wherein the defrost mode comprises a first stage defrost mode and a second stage defrost mode;

wherein the refrigeration system is configured to perform a first transition between the refrigeration mode and the first stage defrost mode, the first transition comprising closing the receiver outlet valve without opening the bypass valve or closing the receiver inlet valve; and wherein the refrigeration system is configured to perform a second transition between the first stage defrost mode and the second stage defrost mode, the second transition comprising opening the bypass valve and closing the receiver inlet valve.

7. The refrigeration system of claim 6, further comprising:

a sensor configured to measure a pressure of the refrigerant at the evaporator;

wherein the refrigeration system is configured to perform the second transition in response to the pressure of the refrigerant at the evaporator dropping below a threshold value.

8. The refrigeration system of claim 6, wherein the second transition further comprises:

opening the receiver outlet valve; and operating the expansion valve to control an amount of liquid refrigerant from the receiver permitted to mix with vapor refrigerant delivered to the evaporator via the second parallel path.

9. The refrigeration system of claim 1, further comprising:

one or more sensors configured to measure a state of the refrigerant at an inlet of the compressor;

wherein the refrigeration system is configured to use information from the one or more sensors to determine a density of the refrigerant and an amount of superheat of the refrigerant at the inlet of the compressor;

wherein the refrigeration system is configured to operate the expansion valve in the defrost mode to maximize the density of the refrigerant while maintaining the refrigerant in a superheated state.

10. A method for defrosting a refrigeration system, the method comprising:

using a compressor to circulate a refrigerant between a condenser and an evaporator via a first parallel path fluidly connecting an outlet of the condenser with an inlet of the evaporator, the first parallel path comprising:

a receiver configured to store the refrigerant in a liquid state, the receiver having a receiver inlet valve and a receiver outlet valve;

an expansion valve fluidly connected in series between the receiver outlet valve and the inlet of the evaporator; and the refrigerant which flows from the condenser to the evaporator via the first parallel path when the refrigeration system operates in a refrigeration mode;

using the compressor to circulate the refrigerant between the condenser and the evaporator via a second parallel path arranged in parallel with the first parallel path, the second parallel path comprising:

a bypass valve fluidly connected in series between the outlet of the condenser and the inlet of the evaporator; and the refrigerant which flows from the condenser to the evaporator via the second parallel path when the refrigeration system operates in a defrost mode, the refrigerant in the second parallel path comprising heat absorbed from an ambient medium flowing through the condenser;

operating the receiver inlet valve, the receiver outlet valve, and the bypass valve to transition between the refrigeration mode in which the refrigerant flows from the condenser to the evaporator via the first parallel path and the defrost mode in which the refrigerant flows from the condenser to the evaporator via the second parallel path;

absorbing heat in the evaporator and rejecting heat in the condenser in the refrigeration mode;

absorbing heat in the condenser and rejecting heat in the evaporator in the defrost mode;

using the evaporator to transfer heat to the refrigerant in the refrigeration mode and absorb heat from the refrigerant in the defrost mode;

using the condenser to transfer heat from the refrigerant to the ambient medium flowing through the condenser in the refrigeration mode and transfer heat from the ambient medium flowing through the condenser to the refrigerant in the defrost mode; and delivering the refrigerant to the condenser at a refrigerant temperature below the temperature of the ambient medium flowing through the condenser in the defrost mode such that the refrigerant absorbs heat from the ambient medium flowing through the condenser and transfers the heat absorbed from the ambient medium to the evaporator.

11. The method of claim 10, wherein in the refrigeration mode:

the receiver inlet valve and the receiver outlet valve are open to allow the refrigerant to flow from the outlet of the condenser to the inlet of the evaporator via the first parallel path; and the bypass valve is closed to prevent the refrigerant from flowing from the outlet of the condenser to the inlet of the evaporator via the second parallel path.

12. The method of claim 10, wherein in the defrost mode:

at least one of the receiver inlet valve and the receiver outlet valve are closed to prevent the refrigerant from flowing from the outlet of the condenser to the inlet of the evaporator via the first parallel path; and the bypass valve is open to allow the refrigerant to flow from the outlet of the condenser to the inlet of the evaporator via the second parallel path.

13. The method of claim 10, wherein the defrost mode comprises a first stage defrost mode and a second stage defrost mode, the method further comprising:

performing a first transition between the refrigeration mode and the first stage defrost mode, the first transition comprising closing the receiver outlet valve without opening the bypass valve or closing the receiver inlet valve; and performing a second transition between the first stage defrost mode and the second stage defrost mode, the second transition comprising opening the bypass valve and closing the receiver inlet valve.

14. The method of claim 13, further comprising:

measuring a pressure of the refrigerant at the evaporator; and performing the second transition in response to the pressure of the refrigerant at the evaporator dropping below a threshold value.

15. The method of claim 13, wherein the second transition further comprises:

opening the receiver outlet valve; and operating the expansion valve to control an amount of liquid refrigerant from the receiver permitted to mix with vapor refrigerant delivered to the evaporator via the second parallel path.

16. The method of claim 10, further comprising:

measuring a state of the refrigerant at an inlet of the compressor;

using the measured state of the refrigerant at the inlet of the compressor to determine a density of the refrigerant and an amount of superheat of the refrigerant at the inlet of the compressor; and operating the expansion valve in the defrost mode to maximize the density of the refrigerant while maintaining the refrigerant in a superheated state.

* * * * *